US005085204A

United States Patent [19]

Moyer

[11] Patent Number: 5,085,204

[45] Date of Patent: Feb. 4, 1992

[54] MOUNTING OF DOOR GASKET

[76] Inventor: James D. Moyer, 301 N. Woodmont Dr., Downingtown, Pa. 19335

[21] Appl. No.: 731,650

[22] Filed: Jul. 17, 1991

[51] Int. Cl.[5] ..... F23M 7/00

[52] U.S. Cl. ..... 126/190

[58] Field of Search ..... 126/190, 200; 49/479, 49/493, 485, 498; 277/166, 185

[56] References Cited

U.S. PATENT DOCUMENTS

| | | | |
|---|---|---|---|
| 3,439,668 | 4/1969 | Tilus | 126/190 |
| 3,507,266 | 4/1970 | Vohasch | 126/190 |
| 4,822,060 | 4/1989 | Moyer et al. | 126/190 |

*Primary Examiner*—Carroll B. Dority

*Attorney, Agent, or Firm*—William H. Holt

[57] ABSTRACT

A manner of mounting a roll-type gasket in a corner of a door, particularly a door of a self-cleaning oven. The gasket is mounted within a corner of the inner wall of the door and when the door closes, the gasket is compressed so as to roll the gasket towards a normal wall of such corner if it is restrained against movement on the associated peripheral part forming another part of such corner. The gasket is retained within the corner by utilizing pointed anchoring tabs or clips which have their points facing the normal wall so as to effect such a rolling action of the gasket when the door is closed. The gasket may be retained in place by single anchoring tabs, sets of anchoring tabs or by separately formed anchoring tabs.

20 Claims, 3 Drawing Sheets

Fig.3
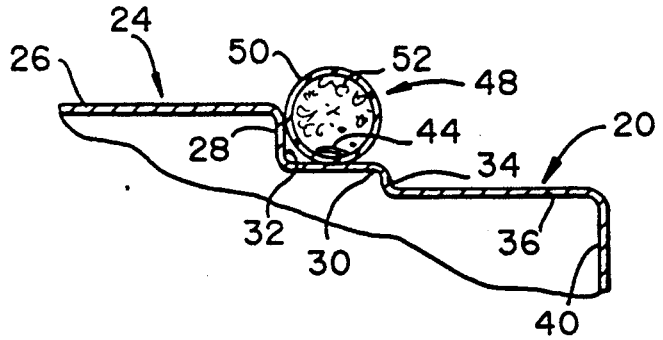
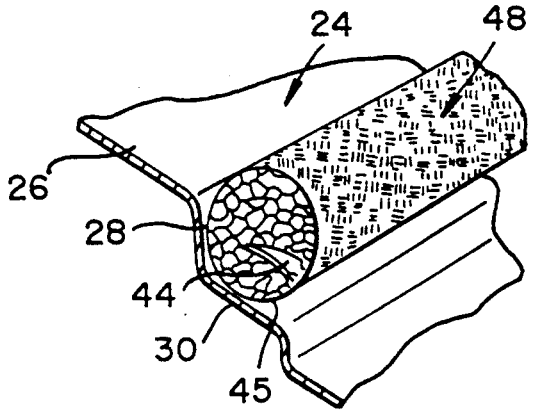
Fig.4
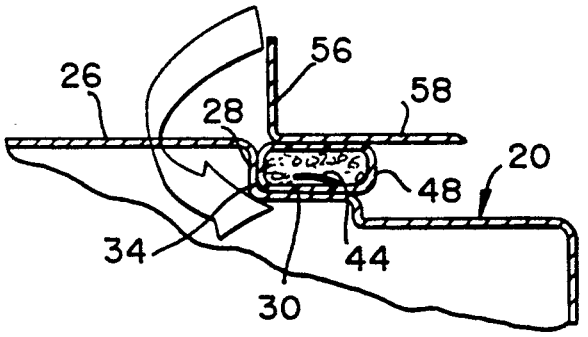
Fig.5
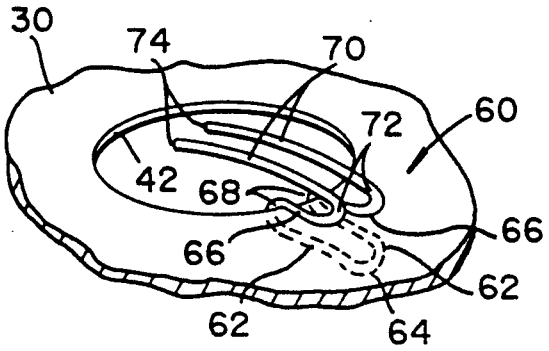
Fig.6
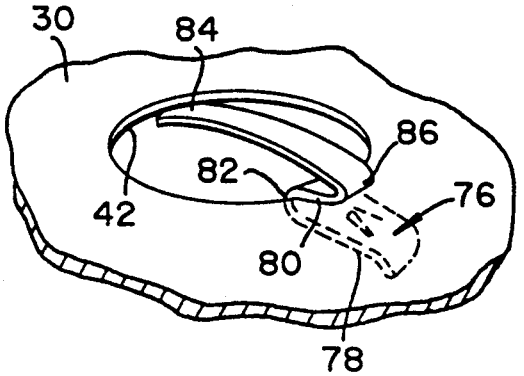
Fig.7

MOUNTING OF DOOR GASKET

This invention relates in general to new and useful improvements in the mounting of gaskets, and more particularly, in the mounting of a roll-type gasket on a shoulder portion of a door.

BACKGROUND OF THE INVENTION

A roll-type gasket is particularly utilized in conjunction with oven doors for effecting a seal between an oven door and the oven per se. Such gaskets are normally formed of a braided cover of fiberglass yarn encasing therein a knitted stainless steel core sleeve. The mounting of such gaskets on oven doors in particular is somewhat complex and is such that it is difficult to replace the gasket when rt becomes worn or ruptured.

The Tilus U.S. Pat. No. 3,439,668 discloses a typical oven door gasket mounting wherein the door panel must be formed in two parts and the gasket clamped against the outer part by the inner part.

On the other hand, as shown in the Vonasch U.S. Pat. No. 3,507,266, the door may be provided with a special anchoring strip having a plurality of tabs struck therefrom. The tabs, however, do not cooperate with the oven door in a manner to aid in the anchoring of the gasket in the forming of a seal between the oven door and the oven when the door is closed.

SUMMARY OF THE INVENTION

Many doors, particularly oven doors, include an inner door panel which is formed with a projecting panel portion that normally is received in the opening defining the oven. This results in the formation of a corner in which a roll-type gasket is positioned. It has been found that when such a door is closed, the gasket is compressed in a manner wherein it has a tendency to roll inwardly towards the projecting panel portion. In accordance with this invention, it has been found that a roll -type gasket may be simply anchored relative to a door having a projecting panel portion by providing such a door with anchoring tabs that face towards the projecting panel portion, thereby resulting in the gasket, when the door is closed, rolling towards the projecting panel portion and forming a tight seal therewith while being forced onto the projecting tabs to more firmly anchor the gasket.

With the above and other objects in view that will hereinafter appear, the nature of the invention will be more clearly understood by reference to the following detailed description, the appended claims, and the several views illustrated in the accompanying drawings.

FIG. 3 is a fragmentary vertical sectional view taken through the inner wall of the oven door and shows specifically the mounting of a roll-type gasket on the anchoring tab specifically shown in FIG. 2.

FIG. 4 is a schematic fragmentary perspective view showing the roll-type gasket in place on the oven door and retained there by the anchoring tab.

FIG. 5 is a fragmentary schematic vertical sectional view through the inner wall of an oven door and the oven per se showing the roll-type gasket being compressed and its tendency to roll into tight sealing engagement with the oven door.

FIG. 6 is a fragmentary perspective view showing a modified form of anchoring tab.

FIG. 7 is a fragmentary perspective view showing yet another modified form of anchoring tab.

DESCRIPTION OF PREFERRED EMBODIMENT OF THE INVENTION

Figure 1:
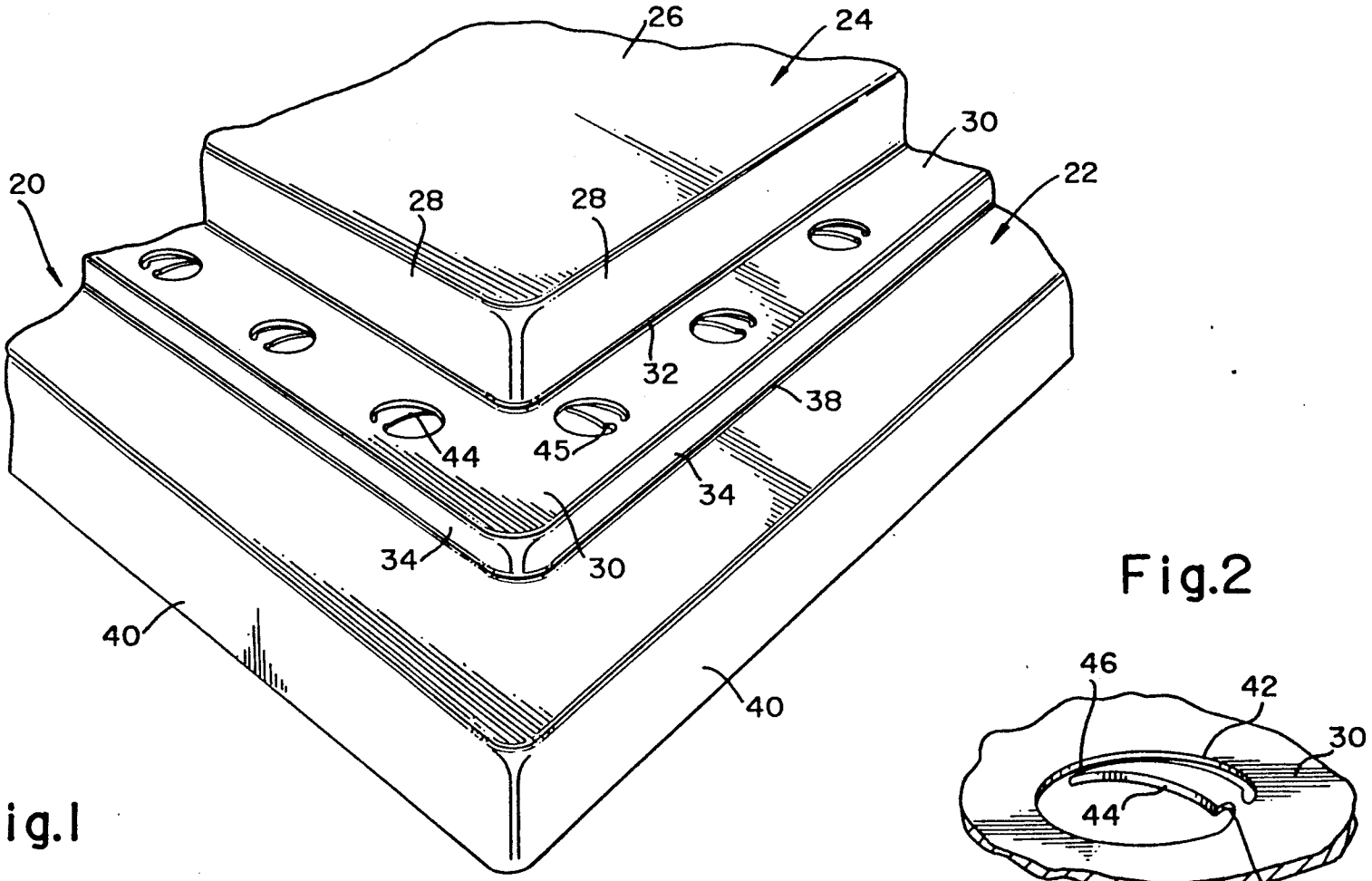
FIG. 1 is a fragmentary perspective view of a conventional type of self-cleaning oven door provided with anchoring means in accordance with the invention.

This invention is particularly directed to the installation of a sealing gasket on the inner surface of a self-cleaning oven door. Such a door construction is illustrated in FIG. 1 and identified by the numeral 20. The invention, however, is not specifically restricted to self-cleaning oven doors.

For descriptive purposes, it will be seen that the door 20 includes an inner panel, generally identified by the numeral 22, which is of a stepped construction and includes a centermost projecting panel portion 24 which includes a wall 26 surrounded by walls 28 disposed generally normal to the panel portion 26. Surrounding the walls 28 is a peripheral part 30 which is generally planar and which defines with the walls 28 corners 32.

The inner panel 22 may be of a further stepped construction and include normal walls 34 connecting the peripheral part 30 and outer part 36 to provide corners 38.

The door panel 22 may also include further normal walls 40 which form edges of the door 22, but which form no part of this invention.

Figure 2:
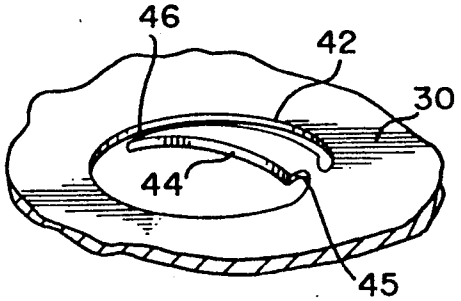
FIG. 2 is an enlargement of a portion of the inner wall of the oven door and shows the specific details of an anchoring tab.

This invention has to do with the mounting of a roll-type gasket which extends around the projecting panel portion 24 and is seated in the corners 32 so as to bear against in sealing relation both the normal walls 28 and the peripheral part 30. In a preferred embodiment of this invention, the peripheral part 30 is provided at spaced intervals with generally circular openings 42 which in their formation result in there being struck from the peripheral part 30 for each opening 42 a pointed anchoring tab 44 as is best shown in FIG. 2. Each anchoring tab 44 is of an arched construction and arches away from the surface of the peripheral part 30 upwardly generally towards an associated normal wall 28 and then downwardly generally towards the opening 42. Each anchoring tab 44 is of a tapered construction and, preferably, is provided at its base, or along its length, with burs or barbs 45 and terminates in a point 46 which generally faces the associated normal wall 28.

In accordance with this invention, a conventional tubular, or roll-type gasket 48, as shown in FIG. 3, is mounted on the door 20 utilizing the anchoring tabs 44. As is best shown in FIGS. 3 and 4, the gasket 48 is in the form of a knitted stainless steel sleeve 50 encased by a braided fiberglass yarn cover 52. The anchoring tab 44, due to its pointed end 46, may freely pass through the mesh sleeve 50 and cover 52 to the position shown in FIGS. 3 and 4 and be secured therein by barbs 45 for holding gasket 48 in place.

Referring now to FIG. 5, it will be seen that the oven of which the door 20 is a part, has an oven defining wall 56 and a vertical front wall 58. As the oven door 20 is closed and the gasket 48 is brought in to contact with the front wall 58 of the oven, it will be seen that the gasket 48 is not only compressed, but is also rotated in a counterclockwise direction. With the bottom of the gasket 48 anchored by the anchoring tabs 44, the bottom of the gasket 48 cannot move to the right, as viewed in FIG. 5, and therefore rolls more tightly against the normal wall 28 so as to form a tight seal not only between the gasket 48 and the peripheral part 30, but also between the gasket 48 and the normal wall 28. Further, the pressure on the gasket 48 serves to more securely mount the gasket on the anchoring tabs 44.

Although the integral anchoring tabs 44 form simple anchoring means for the gasket 48, it is feasible to provide the peripheral part 30 with suitable openings or cutouts, such as the circular openings 42 and to provide separately formed clips. In FIG. 6 there is illustrated a separately formed clip 60 which is of a generally Z-shaped outline and is bent from a single piece of wire doubled upon itself. The clip 60 includes inner anchoring legs 62 which are spaced apart and joined together by a bend in the wire, the bend being identified by the numeral 64 and being the bend formed when the wire is doubled. The clip 60 also includes outer anchoring legs 66 which are joined to the legs 62 by reverse bends 68. The legs 62, 66 engage over the peripheral part 30 with the bends 68 being generally disposed within the opening 42 to secure the clip 60 to the peripheral part 30.

The clip 60 further includes a pair of spaced anchoring legs 70 which are joined to the legs 66 by reverse bends 72. The legs 70 terminate in pointed ends 74. The clip 60 functions substantially in the same manner as the anchoring tab 44.

On the other hand, the clip may be formed of sheetmetal as is shown in FIG. 7 wherein a sheetmetal Z-shaped anchoring clip generally identified by the numeral 76 is shown. The clip includes an inner retaining leg 78 and an outer retaining leg 80 joined together by a reverse bend 82. The legs 78, 80 serve to anchor the clip 76 on the peripheral part 30 partially within one of the openings 42.

The clip 76 also includes a pointed anchoring leg 84 which is joined to the outer leg 80 by a reverse bend 86. It will be readily apparent that the clip 76 will function in the same manner as the anchoring tab 44.

Figure 8:
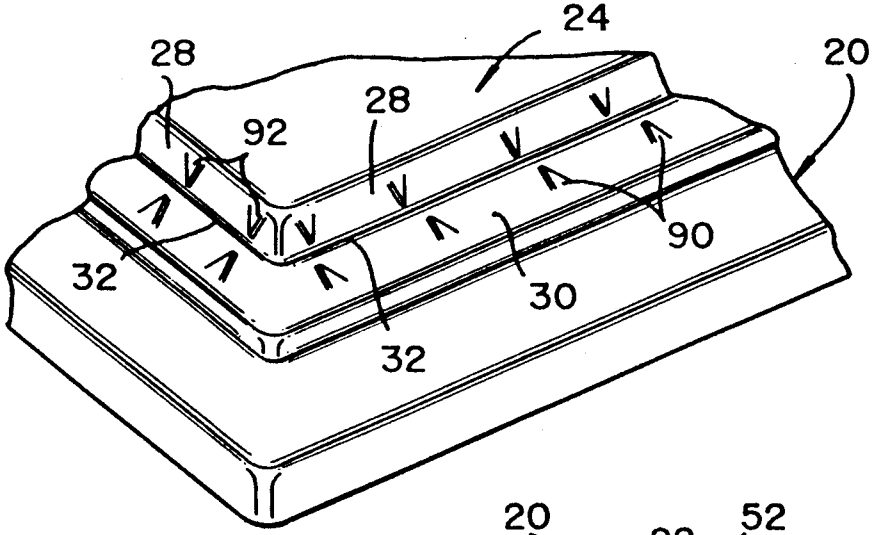
FIG. 8 is a fragmentary perspective view similar to FIG. 1 showing the oven door panel provided with a still further type of anchoring tab arrangement.

Reference is now made to the door 20 having modified anchoring means as is specifically shown in FIG. 8. The door 20 is of the same construction as the door illustrated in FIG. 1 and will include corners 32 defined by normal walls 28 and a peripheral part 30.

The peripheral part 30 has directly struck therefrom a plurality of anchoring tabs 90. These anchoring tabs 90 are preferably formed without also forming an opening corresponding to the openings 42 although such openings may be provided if so desired.

The anchoring arrangement of FIG. 8 also includes a second set of anchoring tabs 92 which are struck from the normal walls 28. The anchoring tabs 92 will be of the same arrangement as the anchoring tabs 90. Preferably the anchoring tabs 90 and 92 will be in alignment with one another.

Figure 9:
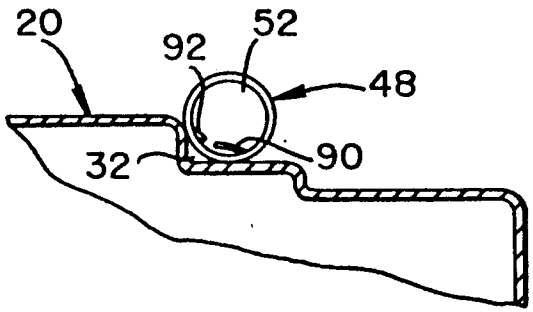
FIG. 9 is a fragmentary transverse sectional view taken through the door of FIG. 8 and showing the mounting of a roll-type, tubular gasket thereon.
Figure 10:
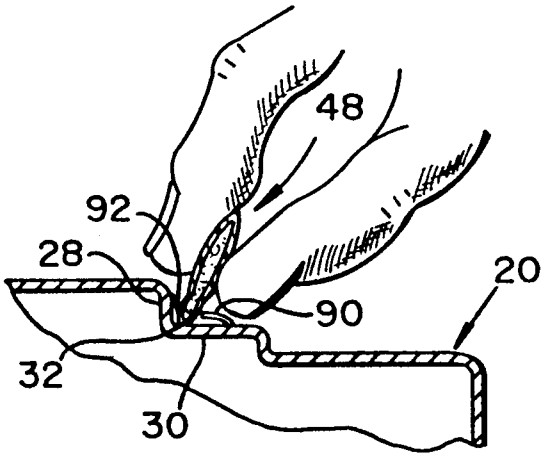
FIG. 10 is a fragmentary transverse sectional view similar to FIG. 9 and shows the manner in which the gasket is squeezed and applied to the door.

As is best shown in FIG. 9, the gasket 48 is retained within the corners 32 by both of the anchoring tabs 90, 92 penetrating the gasket sleeve 52. The gasket 48 is applied by squeezing intermediate portions of the gasket between one's fingers in the manner shown in FIG. 10 and pushing it between the opposed anchoring tabs 90, 92, after which the gasket 48 is released and is generally pressed into the corner so that as it expands, the anchoring tabs 90, 92 will penetrate the sleeve of the gasket.

Although several forms of the anchoring tabs have been specifically illustrated and described herein, it is to be understood that various changes and modifications of the anchoring system for the gasket may be utilized, e.g., burs or barbs 45 may also be used with clip 60, or clip 76, or anchoring tabs 90 and 92, without departing from the spirit and scope of the invention as defined by the appended claimed subject matter.

I claim:

1. A door assembly for receiving a roll-type gasket, said door assembly comprising a door panel including a projecting panel portion for reception in an opening, said panel portion together with an outer peripheral part of said door panel defining a peripheral corner in which a roll-type gasket is to be seated, said corner being formed by a planar surface on said outer peripheral part and a cooperating normal wall on said projecting panel portion, and anchoring tabs on said planar surface for penetrating a roll-type gasket, said anchoring tabs facing said normal wall.

2. A door assembly according to claim 1 wherein said anchoring tabs are integrally struck from said planar surface.

3. A door assembly according to claim 1 wherein said anchoring tabs are integrally struck from said planar surface and generally overlie a larger opening formed in said planar surface.

4. A door assembly according to claim 1 wherein said anchoring tabs are integrally struck from said planar surface and generally overlie a larger circular opening formed in said planar surface.

5. A door assembly according to claim 4 wherein each anchoring tab is arched upwardly relative to said planar surface.

6. A door assembly according to claim 4 wherein each anchoring tab is arched upwardly relative to said planar surface towards said normal wall and then downwardly generally towards said opening.

7. A door assembly according to claim 1 wherein there are second anchoring tabs on said normal wall projecting towards said planar surface.

8. A door assembly according to claim 7 wherein said anchoring tabs are struck from respective ones of said planar surface and said normal wall in alignment with one another.

9. A door assembly according to claim 1 wherein said anchoring tabs are each in the form of a generally Z-shaped clip partially engaged in an opening in said planar surface.

10. A door assembly according to claim 9 wherein said Z-shaped clip is formed of sheet material.

11. A door assembly according to claim 9 wherein said Z-shaped clip is formed of a length of wire folded upon itself.

12. A door assembly according to claim 9 wherein said Z-shaped clip is formed of a length of wire folded upon itself and has two prongs.

13. A door assembly having a roll-type gasket, said door assembly comprising a door panel including a projecting panel portion for reception in an opening, said panel portion together with an outer peripheral part of said door panel defining a peripheral corner in which a roll-type gasket is to be seated, said corner being formed by a planar surface on said outer peripheral part and a cooperating normal wall on said projecting panel portion, and anchoring tabs on said planar surface penetrating said roll-type gasket, said anchoring tabs facing said normal wall and holding said roll type gasket against said normal wall when said gasket is compressed by closing of said door assembly.

14. A door assembly according to claim 13 wherein said anchoring tabs are integrally struck from said planar surface

15. A door assembly according to claim 13 wherein said anchoring tabs are integrally struck from said planar surface and generally overlie a larger opening formed in said planar surface.

16. A door assembly according to claim 13 wherein there are second anchoring tabs on said normal wall projecting towards said planar surface.

17. A door assembly according to claim 13 wherein said anchoring tabs are struck from respective ones of said planar surface and said normal wall in alignment with one another.

18. A door assembly according to claim 13 wherein said anchoring tabs are each in the form of a generally Z-shaped clip partially engaged in an opening in said planar surface.

19. A door assembly according to claim 13 wherein said Z-shaped clip is formed of a length of wire folded upon itself.

20. A door assembly according to claim 1 wherein said anchoring tabs include securing means for holding said gasket thereon.

* * * * *